US006589020B2

(12) United States Patent
Kimura et al.

(10) Patent No.: US 6,589,020 B2
(45) Date of Patent: Jul. 8, 2003

(54) CONTROL VALVE FOR VARIABLE DISPLACEMENT COMPRESSOR

(75) Inventors: Kazuya Kimura, Kariya (JP); Masaki Ota, Kariya (JP); Masahiro Kawaguchi, Kariya (JP); Toshiro Fujii, Kariya (JP); Taku Adaniya, Kariya (JP); Ken Suitou, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/899,343

(22) Filed: Jul. 5, 2001

(65) Prior Publication Data

US 2002/0004012 A1 Jan. 10, 2002

(30) Foreign Application Priority Data

Jul. 6, 2000 (JP) ..... 2000-205152

(51) Int. Cl.[7] ..... F04B 1/26
(52) U.S. Cl. ..... 417/222.2; 62/228.5; 62/228.3
(58) Field of Search ..... 417/222.2; 62/228.5, 62/228.3

(56) References Cited

U.S. PATENT DOCUMENTS 5,584,670 A * 12/1996 Kawaguchi et al. ..... 417/222.2
5,636,973 A * 6/1997 Sonobe et al. ..... 417/222.2
5,713,725 A * 2/1998 Kawaguchi et al. ..... 417/222.2
5,807,076 A * 9/1998 Kawaguchi et al. ..... 184/6.17
5,842,834 A * 12/1998 Kawaguchi et al. ..... 417/222.2
5,865,604 A * 2/1999 Kawaguchi et al. ..... 417/222.2
5,890,878 A * 4/1999 Murase et al. ..... 137/855

FOREIGN PATENT DOCUMENTS

| | | |
|---|---|---|
| EP | 0 952 344 A2 | 10/1999 |
| JP | 10-278567 | 10/1998 |
| JP | 11-223179 | 8/1999 |

* cited by examiner

*Primary Examiner*—Charles G. Freay
*Assistant Examiner*—William H. Rodriquez
(74) *Attorney, Agent, or Firm*—Morgan & Finnegan, LLP

(57) ABSTRACT

A control valve used for a variable displacement type compressor. The compressor has a crank chamber, a discharge pressure zone, and a supply passage. The supply passage connects the crank chamber to the discharge pressure zone. The control valve is located in the supply passage. The control valve has a valve body. The valve body adjusts the size of the opening of the supply passage in accordance with the discharge pressure. The valve body is exposed to the pressure of the supply passage. The valve body moves in accordance with the discharge pressure such that the displacement is varied to counter changes of the discharge pressure. The direction in which the valve body moves in response to an increase of the discharge is the same as the direction in which the valve body moves when the pressure of the supply passage increases.

10 Claims, 7 Drawing Sheets

CONTROL VALVE FOR VARIABLE DISPLACEMENT COMPRESSOR

BACKGROUND OF THE INVENTION

The present invention relates to a control valve for a variable displacement compressor employed, for example, in a vehicle air conditioner.

As shown in FIG. 9, a vehicular variable displacement compressor is provided with a displacement controlling mechanism as disclosed, for example, in Japanese Unexamined Patent Publication No. Hei 10-278567 or in Japanese Unexamined Patent Publication No. Hei 11-223179. The displacement control mechanism has a control valve for controlling the compressor displacement to maintain the discharge pressure having, which correlates with the refrigerant flow rate of a refrigerant circuit, at a target level. The valve position of the control valve is adjusted to adjust the internal pressure of the crank chamber (crank pressure). The compressor changes its displacement according to the crank pressure.

In the displacement control mechanism disclosed in Japanese Unexamined Patent Publication No. Hei 10-278567, a pressure sensor electrically detects the discharge pressure to carry out feedback control of a solenoid control valve based on the detected discharge pressure. In the displacement control mechanism shown in FIG. 9, the discharge pressure Pd is mechanically detected by the control valve CV, and the position of the valve body 101 depends on the detected discharge pressure Pd.

However, in the displacement control mechanism disclosed in Japanese Unexamined Patent Publication No. Hei 10-278567, a pressure sensor, an expensive part, is used. The pressure sensor must be wired manually, which increases the cost of the air conditioning system.

In the displacement control mechanism in FIG. 9, the valve body 101 of the control valve CV is located in a gas passage 102 connecting a discharge chamber to a crank chamber. A force is applied to the valve body 101 to open the gas passage 102 based on the discharge pressure Pd. Further, a force based on the crank pressure Pc within a valve chamber 103 acts upon the valve body 101 to close the gas passage 102. Therefore, the discharge pressure Pd and the crank pressure Pc are involved in positioning of the valve body 101. More specifically, the valve body 101 is positioned to maintain a constant pressure difference between the discharge pressure Pd and the crank pressure Pc.

For example, in the case where the crank pressure Pc is increased excessively, the displacement control mechanism increases the compressor displacement to maintain a constant pressure difference between the discharge pressure Pd and the crank pressure Pc. As a result, the actual discharge pressure Pd exceeds the target discharge pressure Pd (set) by a wide margin, which exerts excessive stress upon the compressor and the piping of the refrigerant circuit. Therefore, it is essential to reinforce the structures of the compressor, piping, etc. or to incorporate an open valve for preventing excessive increases of the discharge pressure Pd in the discharge pressure region. This increases the cost of the air conditioning system.

BRIEF SUMMARY OF THE INVENTION

It is an object of the present invention to provide a control valve for a variable displacement compressor which can smoothly control the discharge pressure using no electrical constitution and which does not cause excessive increase of the discharge pressure.

To attain the above object, the present invention provides a control valve used for a variable displacement type compressor. The compressor varies the displacement in accordance with the pressure of a crank chamber. The compressor has a discharge pressure zone, the pressure of which is a discharge pressure, and a control passage, which connects the crank chamber to a zone in which the pressure is different from the pressure of the crank chamber. The control valve is located in the control passage. The control valve comprises a valve housing. A valve body adjusts the size of the opening of the control passage in accordance with the discharge pressure. The valve body is exposed to the pressure of the control passage. The valve body moves in accordance with the discharge pressure such that the displacement is varied to counter changes of the discharge pressure. The pressure in the control passage is applied to the valve body without hindering movement of the valve body due to an increase of the discharge pressure.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWING

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of a control valve for a variable displacement compressor, which is incorporated in a vehicle air conditioner, will be described with reference to FIGS. 1 to 4.

Figure 1:
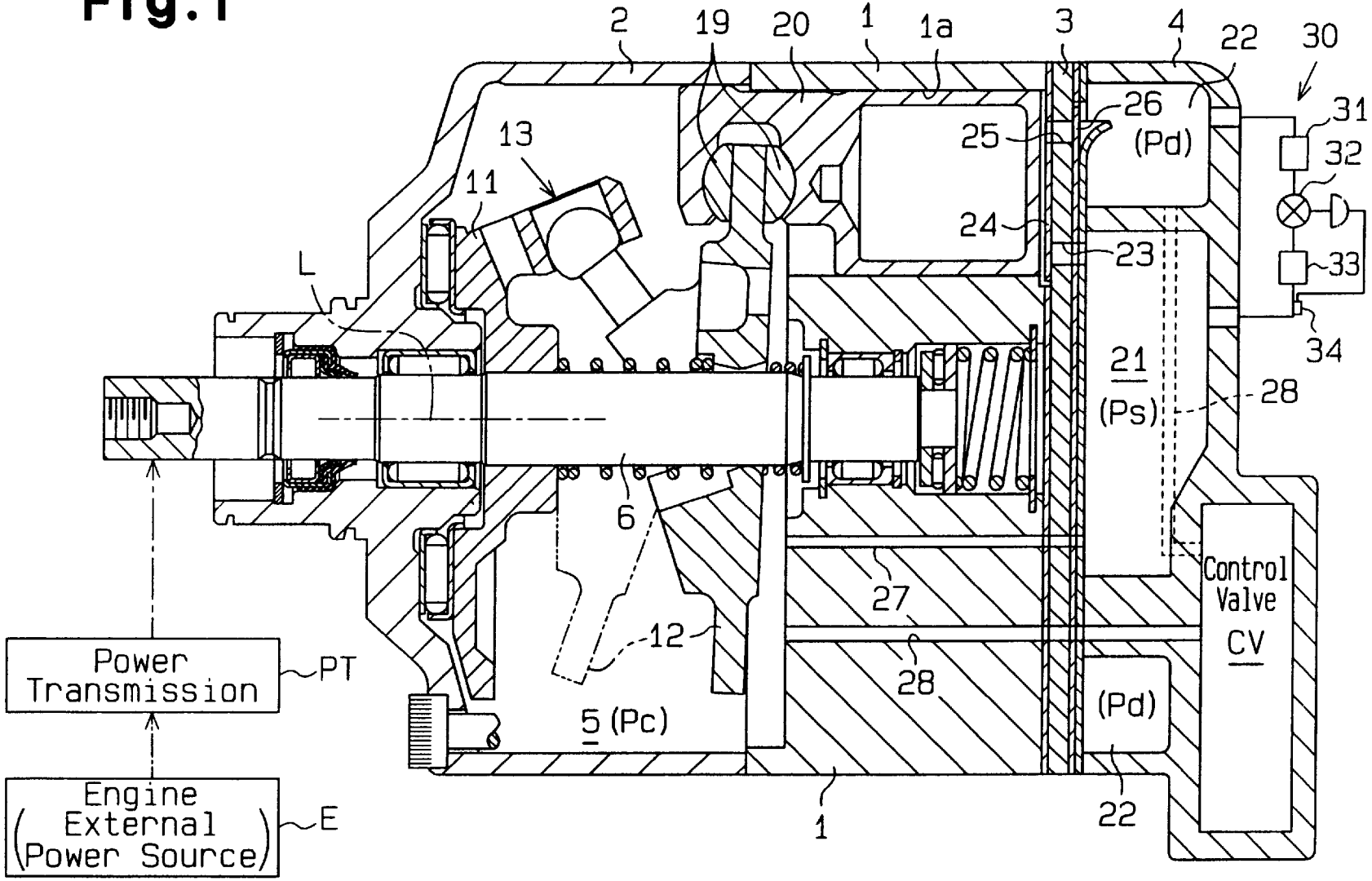
FIG. 1 is a cross-sectional view of the variable displacement swash plate compressor in which a control valve according to a first embodiment of the present invention is included.

The compressor shown in FIG. 1 includes a cylinder block 1, a front housing member 2 connected to the front end of the cylinder block 1, and a rear housing member 4 connected to the rear end of the cylinder block 1. A valve plate 3 is located between the rear housing member 4 and the cylinder block 1.

A crank chamber 5 is defined between the cylinder block 1 and the front housing member 2. A drive shaft 6 is supported in the crank chamber 5. A lug plate 11 is fixed to the drive shaft 6 in the crank chamber 5 to rotate integrally with the drive shaft 6.

The front end of the drive shaft 6 is connected to an external drive source, which is a vehicle engine E in this embodiment, through a power transmission mechanism PT. The power transmission mechanism PT is a clutchless mechanism that includes, for example, a belt and a pulley. Alternatively, the mechanism PT may be a clutch mechanism (for example, an electromagnetic clutch) that selectively transmits power in accordance with the value of an externally supplied current.

A swash plate 12, which is a drive plate in this embodiment, is accommodated in the crank chamber 5. The swash plate 12 is supported by the drive shaft 6. The swash plate 12 can slide along the drive shaft 6 and can incline with respect to the axis of the drive shaft 6. A hinge mechanism 13 is provided between the lug plate 11 and the swash plate 12. The swash plate 12 is coupled to the lug plate 11 and the drive shaft 6 through the hinge mechanism 13. The swash plate 12 rotates synchronously with the lug plate 11 and the drive shaft 6.

Formed in the cylinder block 1 are cylinder bores 1*a* (only one is shown in FIG. 1) at equiangular intervals around the drive shaft 6. Each cylinder bore la accommodates a single headed piston 20 such that the piston can reciprocate in the bore 1*a*. In each cylinder bore 1*a* is defined a compression chamber, the volume of which varies in accordance with the position of the piston 20. The front end of each piston 20 is connected to the periphery of the swash plate 12 through a pair of shoes 19. As a result, the rotation of the swash plate 12 is converted into reciprocation of the pistons 20, and the strokes of the pistons 20 depend on the inclination angle of the swash plate 12.

The valve plate 3 and the rear housing member 4 define, between them, a suction chamber 21 and a discharge chamber 22, which surrounds the suction chamber 21. The valve plate 3 forms, for each cylinder bore 1*a*, a suction port 23, a suction valve 24 for opening and closing the suction port 23, a discharge port 25, and a discharge valve 26 for opening and closing the discharge port 25. The suction chamber 21 communicates with the cylinder bores 1*a* through the respective suction ports 23, and the cylinder bores 1*a* communicate with the discharge chamber 22 through the respective discharge ports 25.

When the piston 20 moves from its top dead center position to its bottom dead center position, the refrigerant gas in the suction chamber 21 flows into the cylinder bore 1*a* through the corresponding suction port 23 and the corresponding suction valve 24. When the piston 20 moves from its bottom dead center position toward its top dead center position, the refrigerant gas in the cylinder bore 1*a* is compressed to a predetermined pressure, and the refrigerant gas is then discharged through the corresponding discharge port 25 and the corresponding discharge valve 26 into the discharge chamber 22, which is also referred to as a discharge pressure zone. The corresponding discharge valve 26 is forced open by the flow of gas.

The inclination angle of the swash plate 12 (the angle between the swash plate 12 and a plane perpendicular to the axis of the drive shaft 6) is determined on the basis of various moments such as the moment of rotation caused by the centrifugal force upon rotation of the swash plate, the moment of inertia based on the reciprocation of the piston 20, and a moment due to the gas pressure. The moment due to the gas pressure is based on the relationship between the pressure in the cylinder bores 1*a* and the crank pressure Pc. The moment due to the gas pressure selectively increases or decreases the inclination angle of the swash plate 12 in accordance with the crank pressure Pc.

In this embodiment, the moment due to the gas pressure is changed by controlling the crank pressure Pc with a displacement control valve CV to be described later. The inclination angle of the swash plate 12 is changed to an arbitrary angle between the minimum inclination angle (shown by a solid line in FIG. 1) and the maximum inclination angle (shown by a broken line in FIG. 1).

As shown in FIG. 1, a control mechanism for controlling the crank pressure Pc essentially includes of a bleed passage 27, a supply passage 28, and a displacement control valve CV, which are defined in the housing. The bleed passage 27 connects the suction chamber 21 to the crank chamber 5. The supply passage 28 is for connecting the discharge chamber 22 and the crank chamber 5. The displacement control valve CV is located in the supply passage 28.

The displacement control valve CV changes the opening degree of the supply passage 28 to control the flow rate of refrigerant gas flowing from the discharge chamber 22 to the crank chamber 5. The pressure in the crank chamber 5 is changed in accordance with the relation between the flow rate of refrigerant gas flowing from the discharge chamber 22 into the crank chamber 5 and the flow rate of refrigerant gas flowing out from the crank chamber 5 through the bleed passage 27 into the suction chamber 21. In accordance with changes in the crank pressure Pc, the difference between the crank pressure Pc and the pressure in the cylinder bores 1*a* varies to change the inclination angle of the swash plate 12. As a result, the stroke of the pistons 20 is changed to control the discharge displacement.

As shown in FIG. 1, the refrigerant circuit of the vehicle air conditioner includes the compressor and an external refrigerant circuit 30. The external refrigerant circuit 30 includes, for example, a condenser 31, an expansion valve 32, and an evaporator 33. The position of the expansion valve 32 is feedback-controlled on the basis of the temperature detected by a temperature sensing tube 34 located near the outlet of the evaporator 33. The expansion valve 32 supplies a quantity of refrigerant corresponding to the thermal load to the evaporator 33 to control the flow rate.

Figure 2:
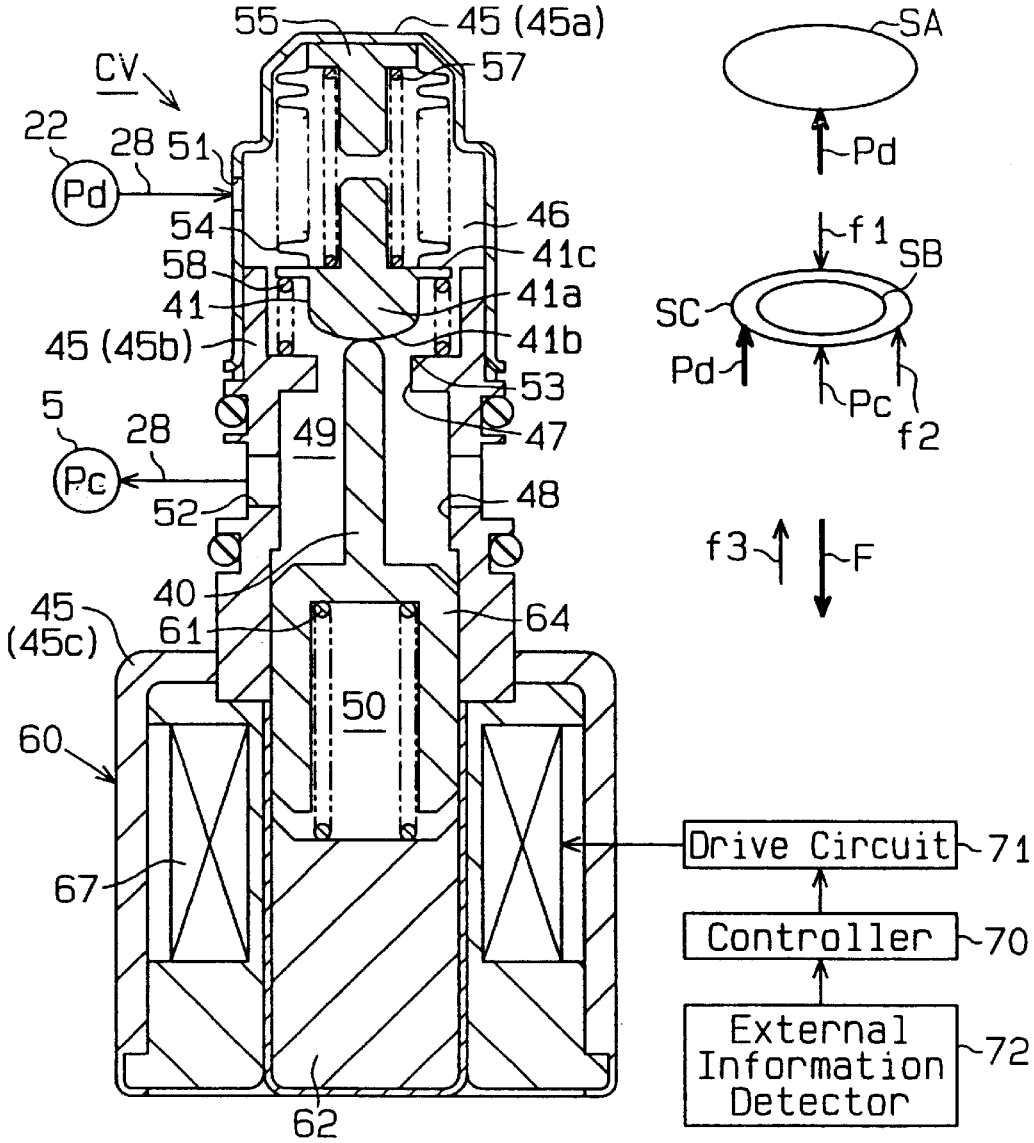
FIG. 2 is a cross-sectional view of the control valve incorporated into the compressor shown in FIG. 1.

As shown in FIG. 2, the control valve CV is provided with an inlet valve portion and a solenoid 60. The inlet valve portion controls the opening degree of the supply passage 28 connecting the discharge chamber 22 with the crank chamber 5. The solenoid 60 serves as an electromagnetic actuator for controlling a valve body 41 located in the control valve CV on the basis of an externally supplied electric current.

A valve housing 45 of the control valve CV has a cap 45*a*, an upper half body 45*b*, and a lower half body 45*c*. Defined in the upper half body 45*b* are a valve chamber 46 and a communication passage 47.

The valve body 41 is located in the valve chamber 46 to move in the axial direction of the control valve CV. The valve body 41 has a cylindrical main body 41*a* and a spherical blocking face 41*b*. The main body 41*a* has a flange 41*c* formed at the upper end thereof. The blocking face 41*b* of the valve body 41 moves toward and away from a valve seat 53 formed between the valve chamber 46 and the communication passage 47.

In the holding space 48, an operating rod 40 is located to be able to move in the axial direction of the control valve CV. The operating rod 40 has a spherical upper end. The upper end of the operating rod 40 is fitted in the communication passage 47. The upper end can enter the valve chamber 46 as the operating rod 40 moves. The cross-sectional area SB of the communication passage 47 is larger than that of the operating rod 40 and is smaller than the cross-sectional area SC of the main body 41*a* (the cylindrical portion excluding the blocking face 41*b*) of the valve body 41.

A bellows 54, or pressure sensing member, is housed in the valve chamber 46. The bellows 54 is fixed at the upper end to a washer 55 attached to the cap 45*a* and at the lower end to the flange 41*c* of the valve body 41. Therefore, the valve body 41 moves up and down integrally with the bellows 54 as the bellows 54 expands and contracts. According to this movement, the distance between the valve body 41 and the valve seat 53, i.e., the opening of the communication passage 47 (supply passage 28), is adjusted.

Within the bellows 54, a first spring 57 is located between the washer 55 and the valve body 41. The first spring 57 urges the valve body 41 downward, or the direction in which the communication passage 47 is closed. A second spring 58 is located between the flange 41*c* of the valve body 41 and the proximity of the valve seat 53 of the upper half body 45*b*, within the valve chamber 46. The second spring 58 urges the valve body 41 upward, or the direction in which the communication passage 47 is opened.

The cap 45*a* of the valve housing 45 has a port 51. The port 51 secures communication between the valve chamber 46 and the discharge chamber 22 through the upstream portion of the supply passage 28 serving as a pressure detecting passage. The valve housing 45 has in the upper half body 45*b* thereof a port 52. The port 52 secures communication among the holding space 48, the communicating chamber 49 and the crank chamber 5 through the downstream portion of the supply passage 28. Thus, the port 51, the valve chamber 46, the communication passage 47, the holding space 48, the communicating chamber 49 and the port 52 constitute a control passage, which is part of the supply passage 28.

A movable iron core 64 formed integrally with the operating rod 40 is housed in the holding space 48 and is movable in the axial direction. The movable iron core 64 divides the holding space 48 into a communicating chamber 49 and a spring chamber 50. A very small clearance (not shown) is defined between the external surface of the movable iron core 64 and the internal wall surface of the holding space 48. The communicating chamber 49 and the spring chamber 50 communicate with each other through this clearance. Therefore, the spring chamber 50 is exposed to the same crank pressure as in the communicating chamber 49.

The bottom of the spring chamber 50 serves also as the upper end face of a fixed iron core 62 in the solenoid 60. A follow-up spring 61 is located between the fixed iron core 62 and the movable iron core 64 within the spring chamber 50. The follow-up spring 61 urges the movable iron core 64 away from the fixed iron core 62, or toward the valve body 41. Thus, the upper end face of the operating rod 40 and the blocking face 41*b* of the valve body 41 are abutted against each other under the force of the first spring 57 and the follow-up spring 61. Here, the operating rod 40 moves up and down integrally with the valve body 41.

The upper end face of the operating rod 40 and the blocking face 41*b* of the valve body 41 are in contact with each other. In the totally closed state where the valve body 41 is seated on the valve seat 53, the blocking face 41*b* of the valve body 41 and the valve seat 53 are brought into contact with each other.

A coil 67 is wound around the fixed iron core 62 and the movable iron core 64. A drive signal is supplied from a drive circuit 71 to the coil 67 based on a command from a controller 70, and the coil 67 generates a level of electromagnetic force F corresponding to the power supply. Supply current value to the coil 67 is controlled by adjusting the voltage to be applied thereto. In this embodiment, duty control is employed for adjustment of the application voltage. The controller 70 determines the duty ratio Dt that is sent as a command to the drive circuit 71 based on external information from external information detecting means 72, which is essentially an air conditioner switch, a temperature setting device and a temperature sensor.

The valve travel of the control valve CV in FIG. 2 is determined by the arrangement of the operating rod 40 including the valve body 41.

First, as shown in FIG. 2, in the absence of current supply to the coil 67 (duty ratio Dt=0%), upward forces of the second spring 58 and the follow-up spring 61 (f2+f3) act upon the valve body 41, so that the valve body 41 opens fully the communication passage 47. Here, the crank pressure Pc assumes the maximum value and the difference between the crank pressure Pc and the internal pressure of the cylinder bore 1*a* is the maximum value. Thus, the inclination angle of the swash plate 12 is minimized to minimize the displacement of the compressor.

When a current of the minimum duty ratio Dt is supplied to the coil 67, the upward force f3 of the follow-up spring 61, from which the downward electromagnetic force F is deducted, is opposed to the downward force f1 of the first spring 57, from which the upward force f2 and the upward force based on the discharge pressure Pd are deducted.

Figure 4:
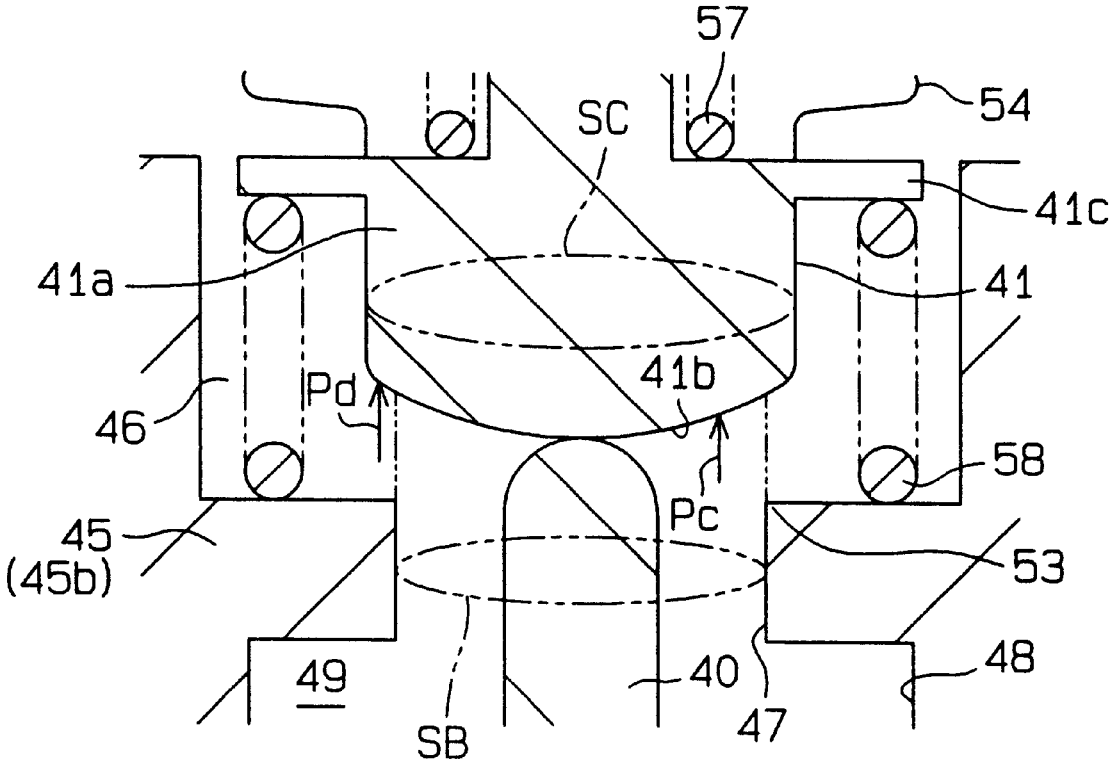
FIG. 4 is an enlarged partial view of FIG. 2.

As shown in FIG. 4, the blocking face 41*b* of the valve body 41 is intersected by an imaginary cylinder (indicated by two vertical broken lines) extended from the wall surface of the communication passage 47. The imaginary cylinder divides the valve body 41 into an inner portion and an outer portion. The effective pressure receiving surface area corresponding to the inner portion of the blocking face 41*b* is expressed by SB. The effective pressure receiving surface area corresponding to the outer portion of the blocking face 41*b* is expressed by SC−SB. The crank pressure Pc in the communication passage 47 acts upon the inner portion in an upward direction. The discharge pressure Pd in the valve chamber 46 acts upon the outer portion in an upward direction.

As shown in FIG. 2, the communicating chamber 49 and the spring chamber 50 are exposed to the same crank pressure Pc through the clearance. The operating rod 40 and the valve body 41 are brought into point contact with each other by their spherical faces. Thus, the effective pressure receiving surface area (receiving the crank pressure Pc of the communicating chamber 49) of the upper end face of the movable iron core 64 is equal to the effective pressure receiving surface area (receiving the crank pressure Pc) of the inner circumferential wall and the lower end face of the movable iron core 64 defining the spring chamber 50. Therefore, the upward force and the downward force based on the crank pressure Pc acting upon the movable iron core 64 cancel each other.

Provided that the upward forces are positive forces, the valve body 41 is positioned with respect to the valve seat 53 such that the relationship among the forces acting upon the bellows 54 and the valve body 41 satisfies the following equation:

$$Pd \cdot SA - f1 + f2 + Pd(SC - SB) + Pc \cdot SB = F - f3,$$

which can be rearranged as follows:

$$(SA + SC - SB)Pd + Pc \cdot SB = F + f1 - f2 - f3 \quad (1).$$

For example, when the speed of the engine E is reduced to reduce the flow rate of the refrigerant in the refrigerant circuit, the discharge pressure Pd, which correlates with the refrigerant flow rate, is reduced, and the upward force based on the discharge pressure Pd becomes smaller than the electromagnetic force F and the force f1 of the first spring 57. Thus, the valve body 41 moves downward to reduce the opening degree of the communication passage 47. As a result, the crank pressure Pc is reduced, and the pressure difference between the crank pressure Pc and the internal pressure of the cylinder bore 1*a* is reduced. Therefore, the inclination angle of the swash plate 12 is increased, which increases the displacement of the compressor. Now that the displacement of the compressor is increased, the flow rate of the refrigerant in the refrigerant circuit and the discharge pressure Pd are increased.

When the speed of the engine E and the flow rate of the refrigerant in the refrigerant circuit increase, the discharge pressure Pd is increased, which increases the upward force based on the discharge pressure Pd. Thus, the valve body 41 moves upward, which increases the opening degree of the communication passage 47. As a result, the crank pressure Pc is increased, and the pressure difference between the crank pressure Pc and the internal pressure of the cylinder bore 1*a* increases. Therefore, the inclination angle of the swash plate 12 is reduced, which reduces the displacement of the compressor. Now that the displacement of the compressor is reduced, the flow rate of the refrigerant in the refrigerant circuit and the discharge pressure Pd are reduced.

Further, for example, in the case where the duty ratio Dt supplied to the coil 67 is increased to increase the force F, the valve body 41 moves downward to reduce the opening degree of the communication passage 47 and to increase the compressor displacement. As a result, the flow rate of the refrigerant in the refrigerant circuit is increased, which increases the discharge pressure Pd.

In the case where the duty ratio Dt supplied to the coil 67 is reduced to reduce the force F, the valve 41 moves upward to increase the opening degree of the communication passage 47 and to reduce the compressor displacement. As a result, the flow rate of the refrigerant in the refrigerant circuit and the discharge pressure Pd are reduced.

Figure 3:
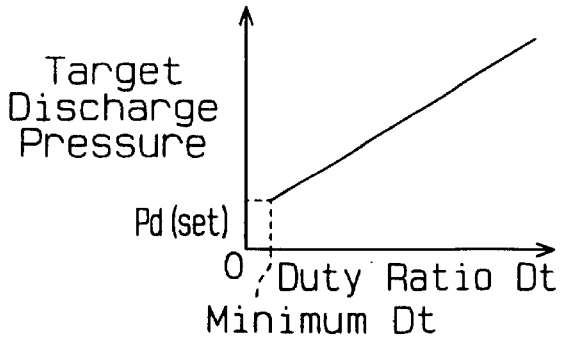
FIG. 3 is a graph of duty ratio vs. target discharge pressure.

As described above, the valve body 41 is positioned such that the control valve CV maintains the target discharge pressure Pd (set) determined by the force F when the crank pressure Pc is constant. As shown in FIG. 3, the target discharge pressure Pd (set) is set at a high value or at a low value by increasing or reducing the force F (duty ratio Dt).

This embodiment has the following effects.

The discharge pressure Pd is mechanically detected in the control valve CV, and the detected discharge pressure Pd is reflected directly in the position of the valve body 41. This eliminates the need for an expensive pressure sensor or the like for electrically detecting the discharge pressure Pd. Further, non-electrical detection of the discharge pressure Pd reduces enumeration parameters of the duty ratio Dt, which reduces the operational load of the controller 70.

As shown in Equation (1), positioning the valve body 41 involves the crank pressure Pc and the discharge pressure Pd. However, the crank pressure Pc acts upon the valve body 41 in the same direction as the discharge pressure Pd (because SA+SC−SB>0 in Equation (1)). Therefore, for example, in the case where the crank pressure Pc is increased when the target discharge pressure Pd (set) is set at the maximum value, the valve body 41 moves in the direction in which the displacement is reduced (valve opening direction), which reduces the discharge pressure Pd. This prevents excessive increases in the discharge pressure Pd.

The target discharge pressure Pd (set) can be changed by changing the duty ratio Dt for controlling the control valve CV (coil 67). Thus, the control valve CV can perform more delicate control compared with a control valve having no electromagnetic device (solenoid 60) and having only a single target discharge pressure Pd (set).

The valve chamber 46 serves also as a part of the supply passage 28 and the pressure sensing chamber. The upstream portion of the supply passage 28 connecting the valve chamber 46 and the discharge chamber 22 serves as a pressure detecting passage, so that no extra pressure sensing chamber or pressure detecting passage is necessary, which reduces the size of the control valve CV and simplifies the structure thereof. In addition, as described the valve body 41 can be fixed directly to the bellows 54, to facilitate the connection between them.

The solenoid 60 is made such that the duty ratio Dt controlling the control valve CV (coil 67) and the target discharge pressure Pd (set) have a positive correlation. Therefore, for example, if the solenoid 60 should get out of order (force F=0), the displacement of the compressor is fixed at the minimum value to reduce the load of the engine E.

Next, a control valve according to a second embodiment will be described referring to FIGS. 5 and 6. In this embodiment, only the differences from the embodiment shown in FIG. 1 will be described. The same or like elements are designated with the same reference numbers, and detailed descriptions of them will be omitted.

Figure 5:
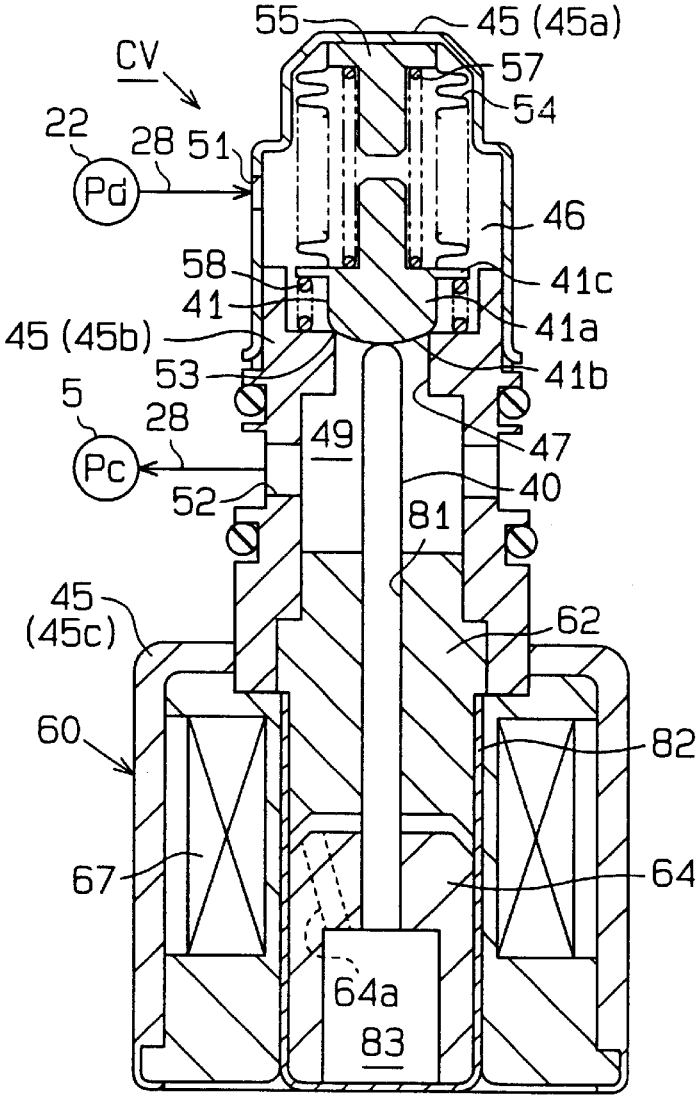
FIG. 5 is a cross-sectional view of the control valve according to a second embodiment.
Figure 6:
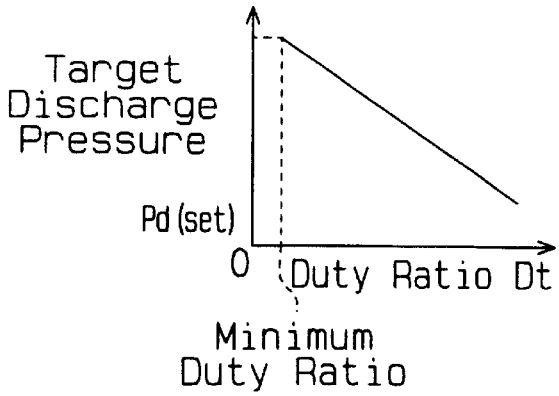
FIG. 6 is a graph of duty ratio vs. target discharge pressure.

As shown in FIGS. 5 and 6, this embodiment is different from the embodiment of FIG. 2 in that the solenoid 60 is made such that the duty ratio Dt and the target discharge pressure Pd (set) have a negative correlation.

The upper end face of the fixed iron core 62 in the solenoid 60 serves as the bottom of the communicating chamber 49. A guide hole 81 is defined through the fixed iron core 62, and the operating rod 40 is fitted in the hole 81. A solenoid chamber 83 is defined between the fixed iron core 62 and a holding cylinder 82 having a closed bottom. The movable iron core 64 is housed in the solenoid chamber 83 and is movable in the axial direction. The lower end portion of the operating rod 40 protrudes into the solenoid chamber 83 and is fitted in a through hole defined at the center of the movable iron core 64. The rod 40 is fixed to the iron core 64 by crimping. Thus, the movable iron core 64 and the operating rod 40 always move integrally.

The crank pressure Pc in the communicating chamber 49 is applied to the solenoid chamber 83 through the clearance between the operating rod 40 and the wall of the guide hole 81. The pressure in the upper space and that in the lower space of the solenoid chamber 83 are equalized through a passage 64*a* defined through the movable iron core 64.

As described above, in this embodiment, the vertical positional relationship between the fixed iron core 62 and the movable iron core 64 in the embodiment shown in FIG. 2 is reversed. If the duty ratio Dt controlling the control valve CV (coil 67) is increased to increase the force F, the solenoid 60 moves the valve body 41 upward. That is, the force for opening the communication passage 47 is increased to reduce the target discharge pressure Pd (set). In other words, the duty ratio Dt controlling the control valve CV and the target discharge pressure Pd (set) have a negative correlation. Therefore, for example, even if the solenoid 60 should get out of order (force F=0), the valve body 41 is immobilized in the state where it closes the communication passage 47, which maximizes the compressor displacement. This satisfies the demand for cooling by passengers.

Next, a control valve according to a third embodiment will be described referring to FIG. 7. In this embodiment, only the differences from the embodiment shown in FIG. 5 will be described. The same or like elements are designated with the same reference numbers, and detailed descriptions of them will be omitted.

Figure 7:
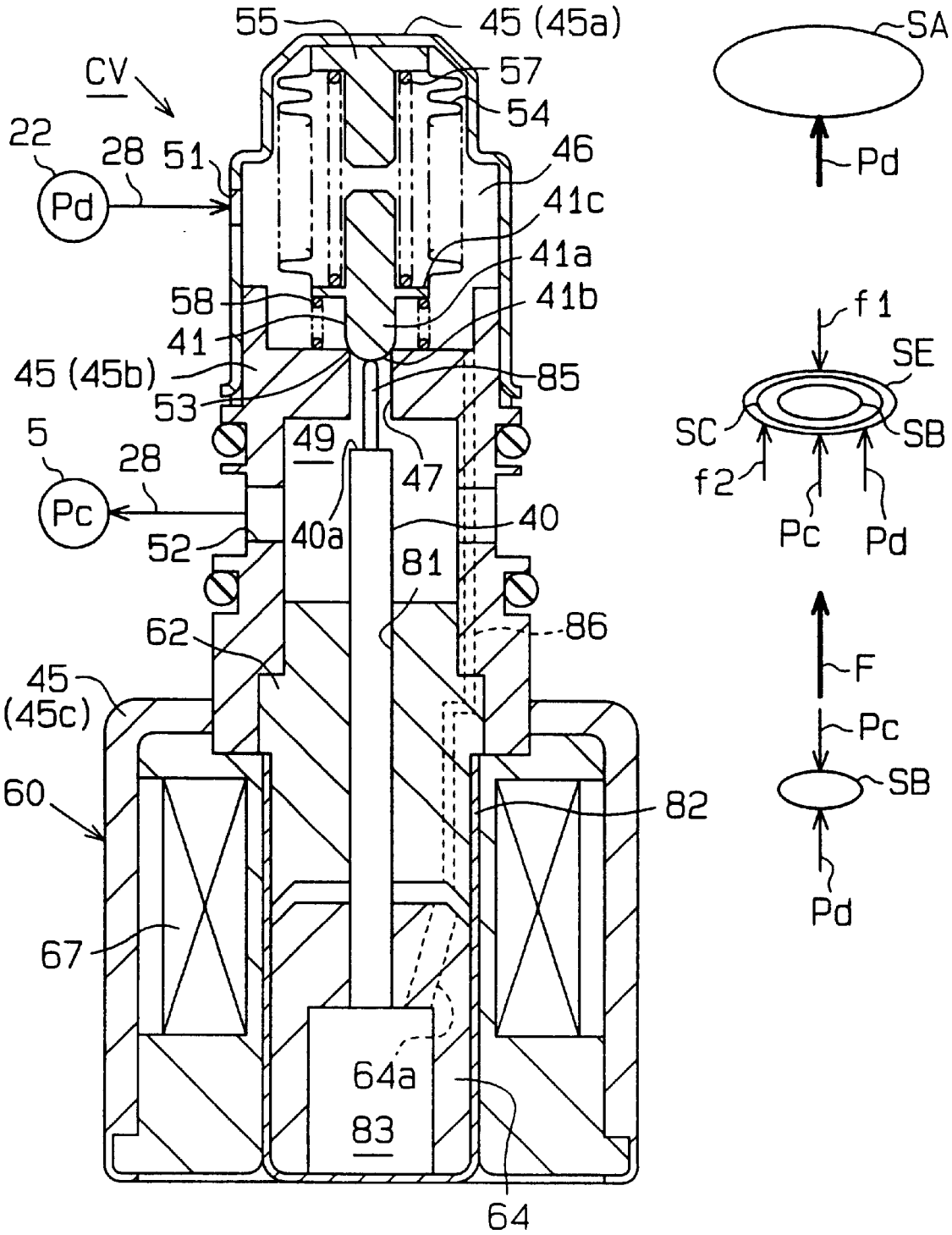
FIG. 7 is a cross-sectional view of the control valve according to a third embodiment.

As shown in FIG. 7, this embodiment is different from that shown in FIG. 5 in that the crank pressure Pc does not affect the positioning of the valve body 41.

The inside diameter of the communication passage 47 is substantially the same as the outside diameter of the operating rod 40. The operating rod 40 has at the distal end face 40*a* a rod-shaped connecting section 85. The distal end face (convex spherical face) of the connecting section 85 is abutted against the blocking face 41*b* of the valve body 41. Therefore, a downward force based on the crank pressure Pc in the communication passage 47 and the communicating chamber 49 acts upon the distal end face of the connecting section 85 and the distal end face 40*a* of the operating rod 40.

There is no clearance for permitting passage of the gas to and from the communicating chamber 49 and the solenoid chamber 83 between the outer surface of the operating rod 40 and the wall of the guide hole 81. The solenoid chamber 83 and the valve chamber 46 are connected to each other through a passage 86 formed in the valve housing 45. Therefore, the solenoid chamber 83 is subjected to the same discharge pressure Pd as the valve chamber 46. An upward force based on the discharge pressure Pd acts upon the movable iron core 64.

Provided that the flange 41*c* of the valve body 41 has a cross-sectional area SE, an upward force based on the discharge pressure Pd in the valve chamber 46 acts upon the lower face of the flange 41*c* and on the effective pressure receiving surface area (SE−SB) of the outer portion of the blocking face 41*b*.

Therefore, provided that the upward forces are positive forces, the valve body 41 is positioned with respect to the valve seat 53 such that the relationship among the forces acting upon the bellows 54 and the valve body 41 satisfies the following equation:

$$Pd \cdot SA - f1 + f2 + Pd(SE - SB) + Pc \cdot SB = Pc \cdot SB - F - Pd \cdot SB,$$

which can be rearranged as follows:

$$Pd(SA + SE(-f1 + f2 = -F \qquad (2)$$

In other words, the valve body 41 position of the depends on the fluctuation of the discharge pressure Pd in the control valve CV so that the valve CV maintains the target discharge pressure Pd (set) determined by the force F. Further, like in FIG. 6, the target discharge pressure Pd (set) is set at a low value and at a high value by increasing and reducing the force F (duty ratio Dt), respectively.

As shown in Equation (2), only the discharge pressure Pd affects the position of the valve body 41 in the control valve CV of this embodiment, and the crank pressure Pc is uninvolved. Therefore, in addition to the same effects as in the embodiments of FIGS. 2 and 5, the control valve performs high-accuracy control of the compressor displacement using, as an index, only the discharge pressure Pd. This improves the air-conditioning and the fuel consumption of the engine E.

The present invention may be modified as follows.

Figure 8:
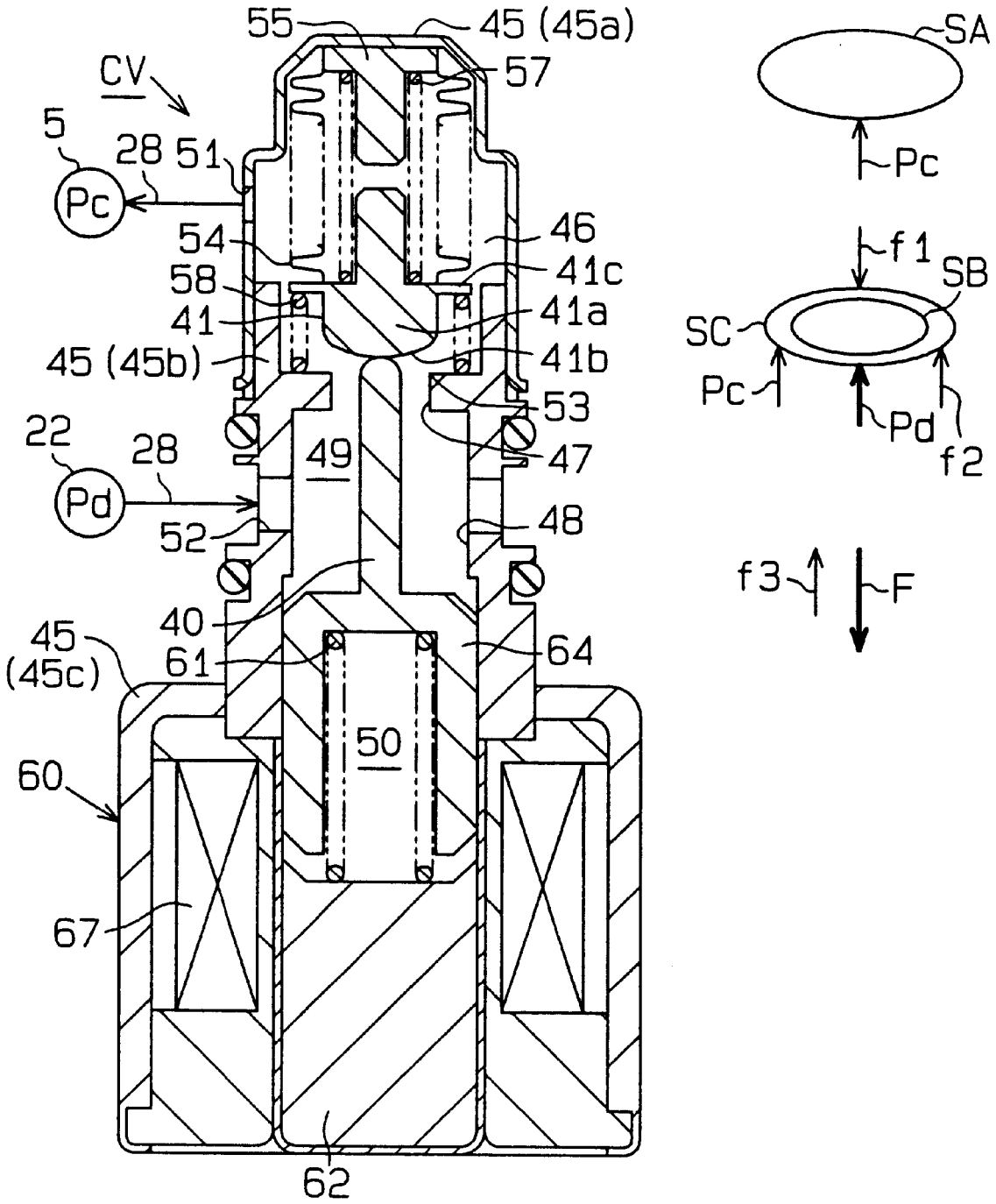
FIG. 8 is a cross-sectional view of the control valve according to a fourth embodiment.
Figure 9:
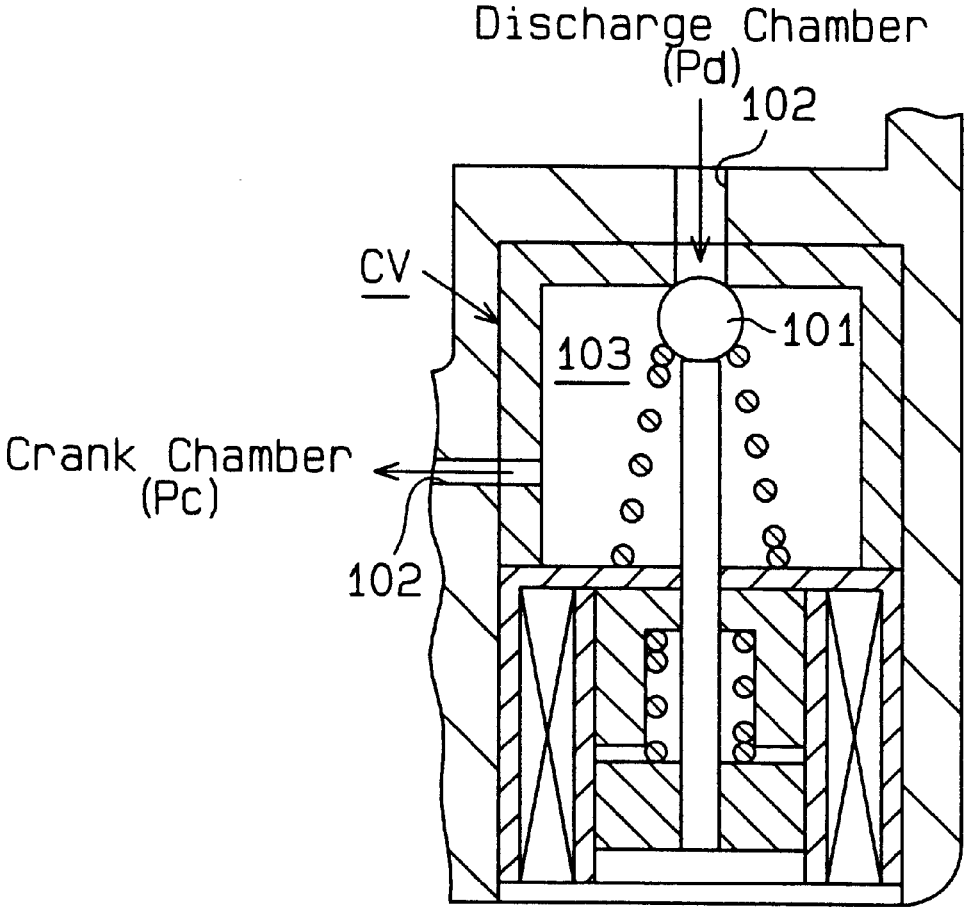
Fig.9(Prior Art)
FIG. 9 is a cross-sectional view of a prior art control valve.

As shown in FIG. 8, the upstream portion (discharge chamber 22 side) and the downstream portion (crank chamber 5 side) of the supply passage 28 are connected to the port 52 and to the port 51, respectively. Thus, the relationship of the control passages 46, 47 and 49 in the embodiment of FIG. 2 may be reversed. In this case, the valve body 41 directly receiving the discharge pressure Pd in the communication passage 47 serves also as a pressure sensing member that can shift depending on the fluctuation of the discharge pressure Pd. That is, the valve body 41 is arranged in the same manner as in the prior art shown in FIG. 9. However, while the force of the crank pressure Pc acts upon the valve body 101 in FIG. 9 in a direction that is opposite to the force of the discharge pressure Pd, the bellows 54 in FIG. 8 allows the crank pressure Pc to act in the same direction as the discharge pressure Pd, in this embodiment.

The control valve CV may be a so-called bleed control valve used for adjusting the crank pressure Pc by adjusting the opening degree of the bleed passage 27 and not of the supply passage 28. In this case, the crank pressure Pc and the suction pressure Ps act, in addition to the discharge pressure Pd, upon the valve body 41, which located in disposed the bleed passage 27.

In each of the above embodiments, the bellows 54, which is used as the pressure sensing member, may be replaced with a diaphragm.

The present invention may be embodied in a control valve of a wobble type variable displacement compressor.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive and the invention is not to be limited to the details given herein, but may be modified within the scope and equivalence of the appended claims.

What is claimed is:

1. A control valve used for a variable displacement type compressor, which varies the displacement in accordance with the pressure of a crank chamber, wherein the compressor has a discharge pressure zone, the pressure of which is a discharge pressure, a suction pressure zone, the pressure of which is a suction pressure, and a control passage, which connects the crank chamber to the discharge pressure zone or the suction pressure zone, wherein the control valve is located in the control passage, the control valve comprising:

a valve housing; and a valve body located in the valve housing and for adjusting the size of the opening of the control passage in accordance with the discharge pressure, the suction pressure or the pressure of the crank chamber, wherein the valve body moves in accordance with the discharge pressure such that the displacement is varied to counter changes of the discharge pressure, wherein the valve body is exposed to the pressure of the control passage, and the direction in which the valve body moves in response to an increase of the discharge is the same as the direction in which the valve body moves when the pressure of the control passage increases.

2. The control valve according to claim 1 further comprising:

a pressure sensitive chamber defined in the valve housing, wherein the pressure sensitive chamber is connected to the discharge pressure zone; and a pressure sensitive member accommodated in the pressure sensitive chamber, wherein the pressure sensitive member moves the valve body in accordance with the pressure of the pressure sensitive chamber.

3. The control valve according to claim 1, wherein the valve body moves in accordance with only the discharge pressure.

4. The control valve according to claim 2, wherein the valve body is located in the pressure sensitive chamber.

5. The control valve according to claim 4, wherein the control passage is a supply passage, which connects the crank chamber to the discharge pressure zone, wherein the pressure sensitive chamber is located in the supply passage, wherein an upstream part of the supply passage, which connects the pressure sensitive chamber to the discharge pressure zone, serves as a pressure detecting passage that applies the discharge pressure to the pressure sensitive chamber.

6. The control valve according to claim 2 further comprising an external controller for determining a target value of the discharge pressure, wherein the pressure sensitive member moves the valve body such that the discharge pressure seeks the target value.

7. The control valve according to claim 6, wherein the external controller is an electromagnetic actuator, which urges the valve body with a force in accordance with the magnitude of a supplied electric current, wherein the force of the electromagnetic actuator corresponds to the target value of the discharge pressure.

8. The control valve according to claim 7, wherein as the force of the electromagnetic actuator increases, the target value of the discharge pressure increases.

9. The control valve according to claim 7, wherein as the force of electromagnetic actuator increases, the target value of the discharge pressure decreases.

10. A control valve used for a variable displacement type compressor, which varies the displacement in accordance with the pressure of a crank chamber, wherein the compressor has a discharge pressure zone, the pressure of which is a discharge pressure, a suction pressure zone, the pressure of which is a suction pressure, and a control passage, which connects the crank chamber to the discharge pressure zone or the suction pressure zone, wherein the control valve is located in the control passage, the control valve comprising:

a valve housing;

a valve body located for adjusting the size of the opening of the control passage, wherein the valve body is exposed to the pressure of the control passage;

a pressure sensitive chamber defined in the valve housing, wherein the pressure sensitive chamber is connected to the discharge pressure zone, the suction pressure or the pressure of the crank chamber; and a pressure sensitive member accommodated in the pressure sensitive chamber, wherein the pressure sensitive member moves the valve body in accordance with the pressure of the pressure sensitive chamber such that the displacement is varied to counter changes of the discharge pressure, and the direction in which the valve body moves in response to an increase of the discharge is the same as the direction in which the valve body moves when the pressure of the control passage increases.

* * * * *

UNITED STATES PATENT AND TRADEMARK OFFICE

CERTIFICATE OF CORRECTION

PATENT NO. : 6,589,020 B2
DATED : July 8, 2003
INVENTOR(S) : Kazuya Kimura et al.

It is certified that error appears in the above-identified patent and that said Letters Patent is hereby corrected as shown below:

Column 9,
Line 55, please delete "(" after "*SE*" and insert therefor -- ) --

Signed and Sealed this

Seventh Day of October, 2003

JAMES E. ROGAN
*Director of the United States Patent and Trademark Office*